US011072947B2

(12) United States Patent
Reddmann

(10) Patent No.: US 11,072,947 B2
(45) Date of Patent: Jul. 27, 2021

(54) MOTOR VEHICLE LOCK

(71) Applicant: Kiekert AG, Heiligenhaus (DE)

(72) Inventor: Uwe Reddmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 564 days.

(21) Appl. No.: 15/773,599

(22) PCT Filed: Nov. 4, 2016

(86) PCT No.: PCT/DE2016/100520
§ 371 (c)(1),
(2) Date: May 31, 2018

(87) PCT Pub. No.: WO2017/076395
PCT Pub. Date: May 11, 2017

(65) Prior Publication Data

US 2019/0078356 A1 Mar. 14, 2019

(30) Foreign Application Priority Data

Nov. 4, 2015 (DE) ..... 10 2015 118 860.0

(51) Int. Cl.
*E05B 77/06* (2014.01)
*E05B 81/16* (2014.01)
(Continued)

(52) U.S. Cl.
CPC ..... *E05B 77/06* (2013.01); *E05B 79/04* (2013.01); *E05B 81/04* (2013.01); *E05B 81/16* (2013.01); *E05B 81/25* (2013.01)

(58) Field of Classification Search
CPC ..... E05B 77/00; E05B 77/02; E05B 77/04; E05B 77/06; E05B 79/04; E05B 79/08;
(Continued)

(56) References Cited

U.S. PATENT DOCUMENTS 5,603,537 A * 2/1997 Amano ..... E05B 81/25 292/201
2004/0046400 A1* 3/2004 Drysdale ..... E05B 77/06 292/216
(Continued)

FOREIGN PATENT DOCUMENTS

DE 20 2010 011805 U1 12/2011
DE 20 2012 007 312 U1 11/2013
(Continued)

OTHER PUBLICATIONS

International Search Report and Written Opinion for corresponding Patent Application No. PCT/DE2016/100520 dated Feb. 27, 2017.
(Continued)

*Primary Examiner* — Kristina R Fulton
*Assistant Examiner* — Christopher F Callahan
(74) *Attorney, Agent, or Firm* — Renner, Otto, Boisselle & Sklar, LLP

(57) ABSTRACT

The invention relates to a lock (1) for a motor vehicle, in particular a side door lock, comprising a locking mechanism (7), a triggering lever (6), an actuating lever (2) and a coupling lever (3), wherein the triggering lever (6) can be coupled to the actuating lever (2) by means of the coupling lever (3), and a means for controlling the coupling lever (3), wherein the coupling lever (3) can be guided by means of a control cam (11).

5 Claims, 4 Drawing Sheets

(51) Int. Cl.
*E05B 79/04* (2014.01)
*E05B 81/04* (2014.01)
*E05B 81/24* (2014.01)

(58) Field of Classification Search
CPC ..... E05B 79/10; E05B 79/00; E05B 81/16; E05B 81/25; E05B 81/04
See application file for complete search history.

(56) References Cited

U.S. PATENT DOCUMENTS

| | | | | |
|---|---|---|---|---|
| 2011/0254287 | A1* | 10/2011 | Akizuki | E05B 77/32 292/223 |
| 2013/0147211 | A1* | 6/2013 | Lee | E05B 77/06 292/198 |
| 2015/0240536 | A1* | 8/2015 | Gumbo | E05B 77/06 292/200 |
| 2016/0115718 | A1* | 4/2016 | Lee | E05B 77/04 292/28 |

FOREIGN PATENT DOCUMENTS

| | | | |
|---|---|---|---|
| DE | 20 2013 104 118 | U1 | 12/2014 |
| DE | 10 2014 001 490 | A1 | 7/2015 |
| DE | 10 2014 002 581 | A1 | 8/2015 |
| DE | 10 2014 004552 | A1 | 10/2015 |
| EP | 1 138 854 | A1 | 10/2001 |
| JP | U56-124149 | | 9/1981 |
| JP | 08-028119 | | 1/1995 |
| WO | 02/20925 | A1 | 3/2002 |
| WO | 2016/131443 | A1 | 8/2016 |

OTHER PUBLICATIONS

Japanese Notice of Reasons for Rejection dated Jun. 11, 2019 issued in counterpart Japanese Patent Application No. 2018-522937, and English Summary thereof.

* cited by examiner

MOTOR VEHICLE LOCK

FIELD OF INVENTION

The invention relates to a lock for a motor vehicle, in particular a side door lock, comprising a locking mechanism, a triggering lever, an actuating lever and a coupling lever, wherein the triggering lever can be coupled to the actuating lever by means of the coupling lever and a means for controlling the coupling lever.

BACKGROUND

A lock for a motor vehicle, also known as a latching system, are largely installed onto the locking mechanisms which consist of a catch and at least one pawl. The locking mechanism in the lock interacts with a lock holder which is either attached to the chassis of the motor vehicle or the door, flap, sliding door, etc. The relative movement between the lock holder and the catch causes the catch to be pivoted and simultaneously for the pawl to engage with the catch.

According to the embodiment, there is a one- or two-step locking mechanism which then assumes a pre-ratchet and/or a main ratchet position. The pawl is preferably engaged with the catch in a spring pre-tensioned manner. A triggering lever is used for unlocking, i.e. to detach the pawl from the catch. The pawl is acted on by the triggering lever in such a way that the pawl disengages with the catch and the catch moves from the ratchet position into an opening position. The catch is hereby moved mainly by means of a spring element and/or on the basis of tensile stress resulting from the lock holder in combination with the door seal.

An actuating lever is used to operate the triggering lever. The actuating lever can be an internal actuating lever or an external actuating lever, for example. The triggering lever moves with the aid of the actuating lever and unlocks the locking mechanism.

Systems which are equipped with mass inertia elements are used to increase motor vehicle safety. The mass inertia elements counteract an external impulse and prevent a side door of a motor vehicle from being unintentionally opened, for example. An impulse can be initiated by a collision into the vehicle, for example. If, for example, an impulse is initiated into the motor vehicle during a side impact such that, for example, a door handle of a side door is accelerated, the deflection of the door handle can thus cause the actuating lever to be activated and the locking mechanism to be opened, whereby unintentional opening of the side door can occur. In order to prevent such unwanted events, mass inertia-based latching systems have become known which counteract unintentional opening of a door lock.

A motor vehicle door lock is known from DE 20 2013 104 118 U1 which is equipped with a mass inertia lock. The motor vehicle lock encompasses a bolting arrangement which is equipped with a control lever and a coupling element. The coupling element is configured with a spring arrangement. In the case of an unoperated actuating lever, the bolting arrangement is bolted or is only unbolted in a spring-driven manner during operation of the actuating lever.

If, during operation of the actuating lever, an actuating speed occurs which is above a pre-determined limit speed, the mass inertia of the control lever thus ensures that the operation of the actuating lever takes place in a time-delayed manner.

Furthermore, a motor vehicle lock with an actuating lever and a coupling arrangement is known from DE 20 2012 007 312 U1. The actuating lever interacts with the coupling arrangement such that the relevant actuating lever uncouples the coupled coupling arrangement and leaves the uncoupled coupling arrangement in the uncoupled state.

If, in the case of accident, the actuating lever is operated with an actuating speed above a certain limit speed, the actuating lever thus executes an idle stroke due to inertia-induced delayed coupling of the coupling arrangement.

A mass inertia-based actuating system for a triggering lever has become known from DE 10 2014 001 490 A1. The actuating lever interacts with a coupling lever which is pivotably mounted on the triggering lever. A spring sitting on the actuating lever engages on the coupling lever and thus enables the coupling lever to couple during operation of the actuating lever. The locking mechanism can be unlocked by means of the triggering lever in the coupled state. In addition, a bolting lever is provided for by means of which the coupling lever can be uncoupled, as also in the case of an accident caused by inertia.

A further mass inertia-based flow system in a lock for a motor vehicle with a separate mass inertia element has become known from DE 10 2014 002 581 A1. A coupling lever is mounted on an actuating lever and is located in a position in a spring pre-tensioned manner in which the coupling lever engages with the triggering lever during operation of the actuating lever.

In the case of exceeding a limit speed of the operation of the actuating lever, a locking lever acts on the coupling joint so that the coupling joint disengages with the triggering lever. The locking lever in turn lies adjacent in a spring pre-tensioned manner on the triggering lever and can follow the movement of the actuating lever if the actuating lever is operated with a normal actuating speed. In the case of an accident, and thus excessive speed of the actuating lever, the control lever cannot follow the movement of the actuating lever by means of the mass inertia element engaged with the control lever and engages with the coupling lever. The control lever causes the coupling lever to be deflected. Bolting of the triggering mechanism for the lock can hereby occur by, for example, the mass inertia element being fixed in the deflected state in which the control lever is engaged with the coupling lever so that also during further operation of the actuating lever no unlocking of the locking mechanism can occur.

The securing systems known from the state of the art are usually based on the coupling joint being controlled by means of a spring element. Spring elements can have great fluctuations in spring constants caused by material characteristics and manufacturing processes. A defined configuration of the springs therefore requires greater effort. Furthermore, control by means of a spring element is always associated with insecurities as temperature fluctuations can also, for example, influence the spring characteristics.

SUMMARY OF INVENTION

The task of the invention is to provide a mass inertia-based actuating system for a lock of a motor vehicle with which a defined control of the coupling behavior can be provided in an actuating system of a latching device of a motor vehicle lock. The task of the invention is to provide an improved lock for a motor vehicle. Furthermore, a task of the invention is to provide a structurally simple and cost-effective possibility to secure a lock in the case of an accident.

The task is solved according to the invention by the characteristics of the disclosure. Advantageous designs of the invention are stated in the disclosure. It is pointed out that the exemplary embodiments described hereafter are not restrictive; instead, any possible variations are possible of the characteristics described in the disclosure.

According to patent claim 1, the task of the invention is solved by a lock for a motor vehicle, in particular a side door lock being provided comprising a locking mechanism, a triggering lever, an actuating lever and a coupling lever, wherein the triggering lever can be coupled to the actuating lever by means of the coupling lever and a means for controlling the coupling lever, wherein the coupling lever can be controlled by means of a control cam. Due to the formation of a control cam according to the invention in which the coupling lever can be controlled, the possibility is now created of guiding the coupling lever regardless of the engagement with a spring element and thus obligatorily causing a defined movement of the coupling lever.

Forced guidance of the coupling lever contains a defined location regulation of the coupling lever at all times which includes a high degree of security and functionality in turn. In particular, by means of forced guidance of the coupling lever in a control cam great forces can be transmitted so that malfunction cannot occur, even with slow operation of the actuating lever executed with great force. In particular, the coupling joint is adjustable at all times in a defined position and by means of formation of the control cam to the different areas of application of the lock in the motor vehicle.

The lock for a motor vehicle also encompasses such latches which are used, for example, in sliding doors, tailgates, side doors, flaps or covers, such as a top cover. The lock normally encompasses a locking mechanism comprising a catch and at least one pawl. The locking mechanism can be formed with a pre-ratchet and/or a main ratchet, whereby one or two pawls can be used.

A triggering lever is the lever which acts directly on the locking mechanism. The triggering lever acts on the pawl and disengages the pawl out of engagement with the catch. A coupling lever acts between the actuating lever and the triggering lever. During operation of the actuating lever and preferably the external actuating lever the coupling lever comes into contact with the triggering lever and thus enables operation of the triggering lever, whereby the locking mechanism can be unlocked. The coupling lever is guided in a control cam so that a defined alignment of the coupling lever can be enabled on the triggering lever. On the one hand, the alignment of the coupling lever can be controlled. Furthermore, the deflection behavior of the coupling lever can also be set by a course of the contour. It is possible to control the deflection angle and also the deflection speed of the coupling lever by the course of the contour. According to the present path during operation of the actuating lever the movement of the coupling lever can thus be set.

In a preferred embodiment of the invention the coupling lever is pivotably accommodated in the actuating lever. The coupling lever is accommodated in the actuating lever and in particular in the external actuating lever offers the advantage that coupling of the actuating lever with the triggering lever can be enabled with a low number of components. Furthermore, the transmission of the movement from the actuating lever to the triggering lever is directly possible. The pivoting accommodation of the coupling lever in the actuating lever hereby enables the coupling lever to be accommodated in the actuating lever on the one hand and is simultaneously guided by the control cam.

If the coupling lever can be guided by means of a control lever, a further advantageous embodiment of the invention thus results. The accommodation of the coupling lever or the guidance of the coupling lever in a control lever hereby enables the control cam to follow the movements of the actuating lever. The control cam can thus be moved jointly to the actuating lever and engaged with the coupling lever jointly with the coupling lever. It is apparent from this arrangement that the control lever can function as a control joint if the control lever executes a relative movement to the actuating lever.

During normal operation of the actuating lever, by means of the engagement of a spring between the actuating lever and the control lever the control lever follows the movement of the actuating lever. The coupling lever is accommodated in the actuating lever and follows the movement of the actuating lever. If the actuating lever is moved at a speed assigned to the operation in normal operation, the control lever thus follows the movement of the actuating lever. The spring acting between the control lever and the actuating lever is configured in such a way that a concurrent movement occurs in normal operation between the control lever and the actuating lever.

Only in the case of excessive speed of the actuating lever, as can occur, for example, in the case of accident, the actuating lever is accelerated so greatly that a relative movement occurs between the control lever and the actuating lever. A relative movement between the control lever and the actuating lever causes the coupling lever to be directed in the control cam of the control lever and can be deflected by the geometry of the control lever contour. Deflection of the coupling lever hereby causes the coupling lever to disengage with the triggering lever. The locking mechanism remains locked.

In a further embodiment of the invention an advantage then results if the control lever is accommodated coaxially at least with the actuating lever, in particular an external actuating lever. Joint accommodation of the control lever and the actuating lever enables a structurally simple configuration which requires little space. Furthermore, the actuating paths and lever moments can easily be attuned to one another by means of the joint accommodation. In particular, the moments to be transmitted which are required on the one hand for triggering of the locking mechanism and also to enable control of the movement of the coupling lever are easily set.

If the control lever interacts with a mass inertia lever, a further advantageous configuration of the invention thus results. A mass inertia lever is a lever which is pivotably accommodated in the motor vehicle lock and counteracts an impulse from an accident. The mass inertia element is preferably formed as a lever and is located centrally. Symmetrical load distribution around the pivot point can be advantageous. The control lever is directly engaged with the mass inertia lever. As already explained above, during a relative movement between the actuating lever and the control lever a deflection of the coupling lever occurs. Due to the inert mass of the mass inertia lever the control lever is assisted in its inertia behavior so that further security is guaranteed in order to hold the control lever in its position in the case of accident. If the mass inertia lever counteracts the impulse of the impact, the mass inertia lever thus remains in its position and holds the control lever against the deflection of the actuating lever or external actuating lever in its starting position. Only the actuating lever is thus deflected, for example by means of a moved door handle and the control lever remains in its starting position. During operation of the actuating lever the coupling lever follows the movement of the actuating lever by means of its accommodation in the actuating lever, whereby the coupling lever is guided by means of the control cam of the control lever and can be deflected accordingly. Operation of the actuating lever in the case of accident thus has no impact on the triggering lever so that the catch also remains closed in the case of accident.

If the control lever is guided in a control contour of the mass inertia lever, a further embodiment of the invention results. By means of direct guidance of the control lever in a contour of the mass inertia lever, an advantageous structural solution results which is equipped with a minimum number of components. Furthermore, it is advantageous if the control lever engages into the contour of the mass inertia lever such that an attack point of the control lever is arranged in the control contour close to the pivot point of the mass inertia lever. By means of an attack point or a guidance of the control lever in the mass inertia lever close to the pivot point of the mass inertia lever the control lever counteracts great mass inertia in the case of accident. In particular where a symmetrical mass distribution is present around the rotational point of the mass inertia lever, in the case of accident the mass inertia lever can counter the control lever with a maximum inertia moment.

Advantageously, the control contour extends from a pivot point of the mass inertia lever located approximately centrally to a radial end of the mass inertia lever. A further advantageous form of the control contour hereby results as on the one hand the mass inertia lever can counter the control lever with a maximum inertia moment in the case of accident. In contrast, during normal operation of the actuating lever the control lever only needs to apply a smaller moment along the control contour in the mass inertia lever with increasing deflection of the actuating lever in order to deflect the mass inertia lever. Operation of the motor vehicle lock is hereby facilitated. The advantageous configuration of the control contour along the extension of the mass inertia lever thus has a positive effect on the behavior in the case of accident and simultaneously during normal operation of the lock.

A further advantageous configuration of the invention results if the control lever has an engagement means, in particular an extension, whereby during operation of the engagement means the coupling lever can be disengaged from the triggering lever. The control lever can have an engagement means into which a central bolting element of the lock can engage, for example. Advantageously the engagement means can be formed as an extension, for example, which protrudes out of the control lever. However, the engagement means can also be formed from an aperture, a depression or another geometric design into which a central bolting means can engage and fixes the control lever in its position. By means of fixing of the engagement means and thus the control lever, although the actuating lever or the external actuating lever can be operated, by means of holding or fixing of the control lever the coupling lever is moved by means of the control cam in the control lever and disengaged with the triggering lever. Hereby with the simplest structural means a bolting element can be provided which grips the available elements of the flow system and in particular the control lever. Bolting can thus be enabled by positioning of the control lever. Advantageously, the engagement means can be molded as a single component to extend the control lever, for example. However, it is naturally also conceivable to fix the control lever in another force-fitting and/or form-fitting form so that movement of the control lever can be prevented.

If the engagement means can be operated electrically, a further advantageous configuration of the invention thus results. Electrical operation offers the advantage of a high level of convenience for the operator so that the control lever can be electrically controlled or positioned or fixed within the scope of central locking of the motor vehicle, for example. An already present lever of a central locking system can be used to engage the control lever or a separate drive can be envisaged.

In a further advantageous embodiment, at least one part of the coupling lever protrudes into an opening of the actuating lever and can be guided into the aperture. In normal operation of the actuating lever, i.e. during operation of the actuating lever with normal opening speed for the lock, the coupling lever lies adjacent to an end of the actuating lever in a spring pre-tensioned manner, for example. If the control lever is now fixed, this can occur on the one hand by means of the engagement means and a central locking system or by means of the mass inertia element, the coupling lever thus travels in the control cam of the control lever, wherein the coupling lever is pivoted. In order to enable pivoting of the coupling lever in the actuating lever, the coupling lever can be guided in the aperture of the actuating lever. Guidance of the coupling lever directly in the actuating lever offers a further option in order to enable a possibility which is as structurally simple as possible and therefore cost-effective to guide the coupling lever with full functionality. The structure of the guides of the mass inertia lever, control lever, coupling lever and actuating lever grasping into one another offers a multitude of advantages for functionality and simultaneously offers the possibility of using all functional advantages with the least possible number of components and a structurally beneficial construction.

In a further advantageous embodiment of the lock the actuating lever, the control lever and the triggering lever are accommodated on a joint axis and/or guide. The joint mounting of the levers offers the advantage that the functional unit can be of as small a construction as possible so that a high degree of functionality can be executed with minimum space in the motor vehicle lock. The levers can be accommodated coaxially and/or on a joint guide or mounting of the other lever in each instance. In particular the coaxial mounting of the lever offers the advantage that in particular for the interplay, for example, between the control lever and the actuating lever beneficial engagement relationships, for example, for the spring acting between the control lever and the actuating lever are provided.

Hereinafter the invention is explained in further detail with reference to the attached drawings on the basis of a preferred exemplary embodiment. However, the principle applies that the exemplary embodiments do not restrict the invention, but only constitute advantageous embodiments. The characteristics portrayed can be executed individually or in combination with other characteristics of the description and also the patent claims individually or in combination.

BRIEF DESCRIPTION OF DRAWINGS

The following are shown.

DETAILED DESCRIPTION

Figure 1:
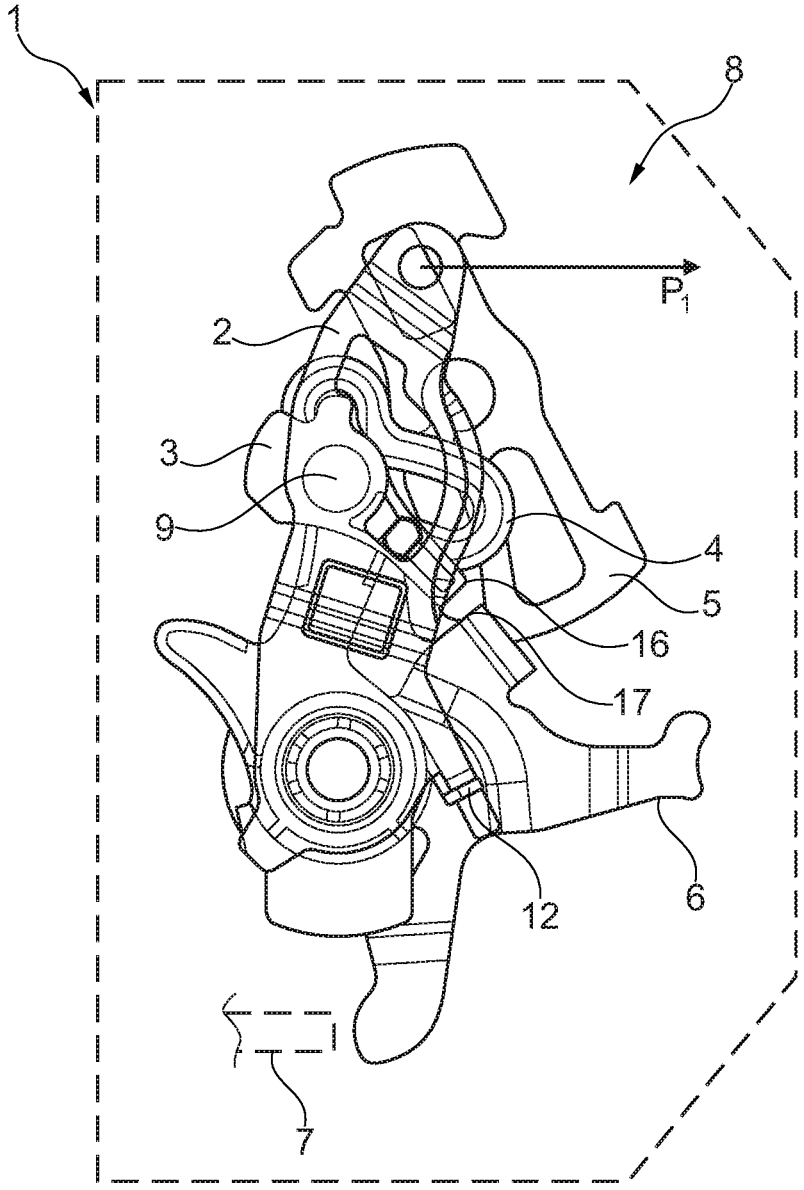
FIG. 1 a front view on a section of a lock of a motor vehicle with crucial components to explain the invention. The front view shows the functional unit in a starting position, i.e. in the unoperated state, FIG. 2 the rear view of the functional unit according to FIG. 1 in the unoperated state, i.e. a starting position, FIG. 3 a front view on the functional unit of the lock during normal operation of the actuating lever to trigger the locking mechanism, and FIG. 4 a front view of the functional unit with greatly accelerated movement of the actuating lever, in which the mass inertia element prevents triggering of the locking mechanism.

A front view on a lock 1 of a motor vehicle is reproduced in FIG. 1. The lock is only indicated as a broken line. The lock 1 encompasses an actuating lever 2, a coupling lever 3, a control lever 4, a mass inertia lever 5, a triggering lever 6 and a locking mechanism 7. The locking mechanism 7 only indicated in dashes can consist of a pawl 7, for example, onto which the triggering lever 6 directly engages. The further component of the lock 1 is dispensed with for the sake of clarity, so that only the crucial components of the lock 1 are reproduced to explain the function of the invention.

Figure 2:
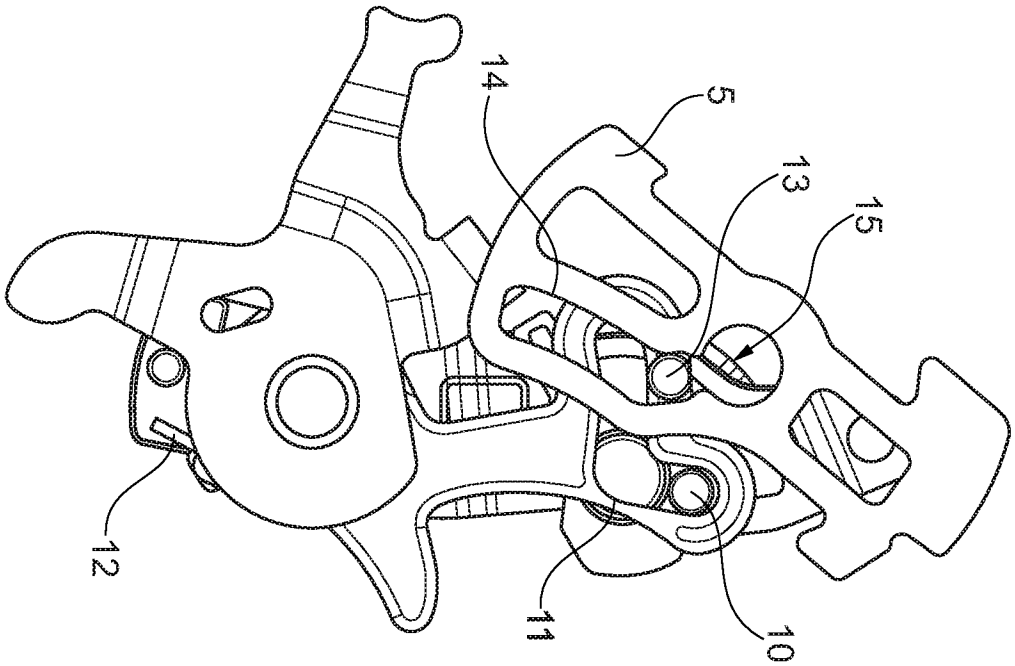

FIG. 1 shows the functional unit 8 of the lock 1 in an unoperated state. In order to operate the actuating lever 2, the actuating lever is operated, for example, by means of a Bowden cable in the direction of the arrow P1 in a clockwise direction. During operation of the actuating lever 2 the coupling lever accommodated in the actuating lever 2 is moved via its axis 9 accommodated in the actuating lever 2. The coupling lever 3 in turn has a tap 10 which is more clearly visible in FIG. 2, with which the coupling lever 3 engages into the control cam 11 of the control lever 54. The actuating lever 2 takes along the control lever 4 in operation of the actuating lever 2 in the direction of the arrow P1. A spring element 12 acts between the actuating lever 2 and the control lever 4. The spring element 12 holds the control lever 4 in its starting position so that the spring element acts with a relative force between the control lever 4 and the actuating lever 2 to a relative movement between the actuating lever 2 and the control lever 4. The spring force of the spring element, which can be a spiral spring in particular, must be overcome in order to create a relative movement between the actuating lever 2 and the control lever 4.

If the pin 10 of the coupling lever 3 interacts with the control lever 4, the control lever 4 in turn thus interacts with the mass inertia lever 5 by means of a guide pin 13. For this purpose, the guide pin 13 engages into a control cam 14 of the mass inertia lever 5. As is clearly apparent in FIG. 2, the guide pin 13 can be guided radially externally in the control cam. The mass inertia lever 5 is accommodated pivotably in the lock 1 around its axis 15. The mass inertia lever 5 preferably has a mass distribution which is in equilibrium in relation to the axis 15. In other words, the mass inertia lever 5 is offset in mass around the axis 15. An offset mass balance in relation to the axis 15 offers the advantage that no natural oscillations can arise due to vibrations in the motor vehicle or can be largely prevented.

Figure 3:
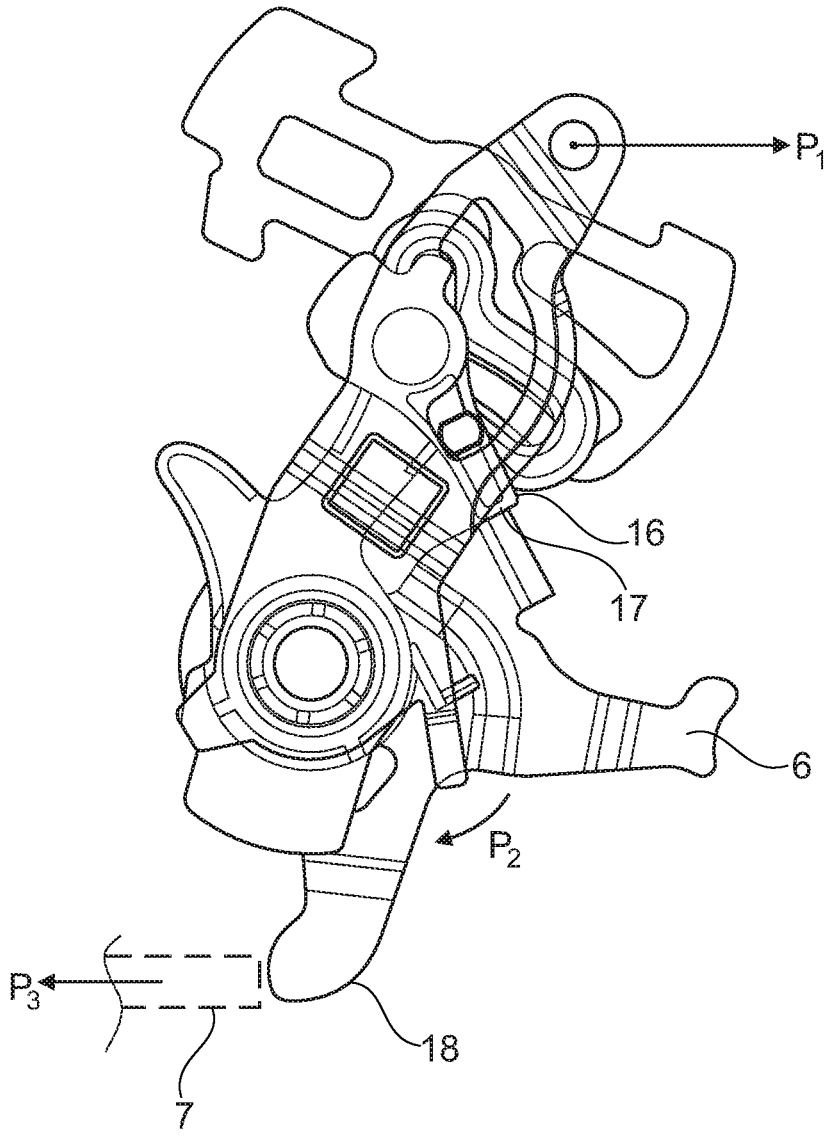

During operation of the actuating lever 2 the coupling lever 3 is consequently operated and where the actuating lever is operated with normal speed, the control lever 4 follows the movement of the actuating lever 2. The consequence of this is that the coupling lever 3 maintains its orientation in the functional unit 8. A radial end 16 of the coupling lever 3 then engages with a stop edge 17 of the triggering lever 6. Such an engagement between the radial end 16 of the coupling lever 3 and the stop edge 17 is reproduced as a normal operation of the lock in FIG. 3. During operation of the triggering lever 6, as illustrated in FIG. 3, the triggering lever 6 executes a movement in the direction of the arrow P2, wherein a triggering arm 18 engages with the pawl 7, for example. The pawl 7 is then moved in the direction of the arrow P3 so that the locking mechanism can be unlocked.

Figure 4:
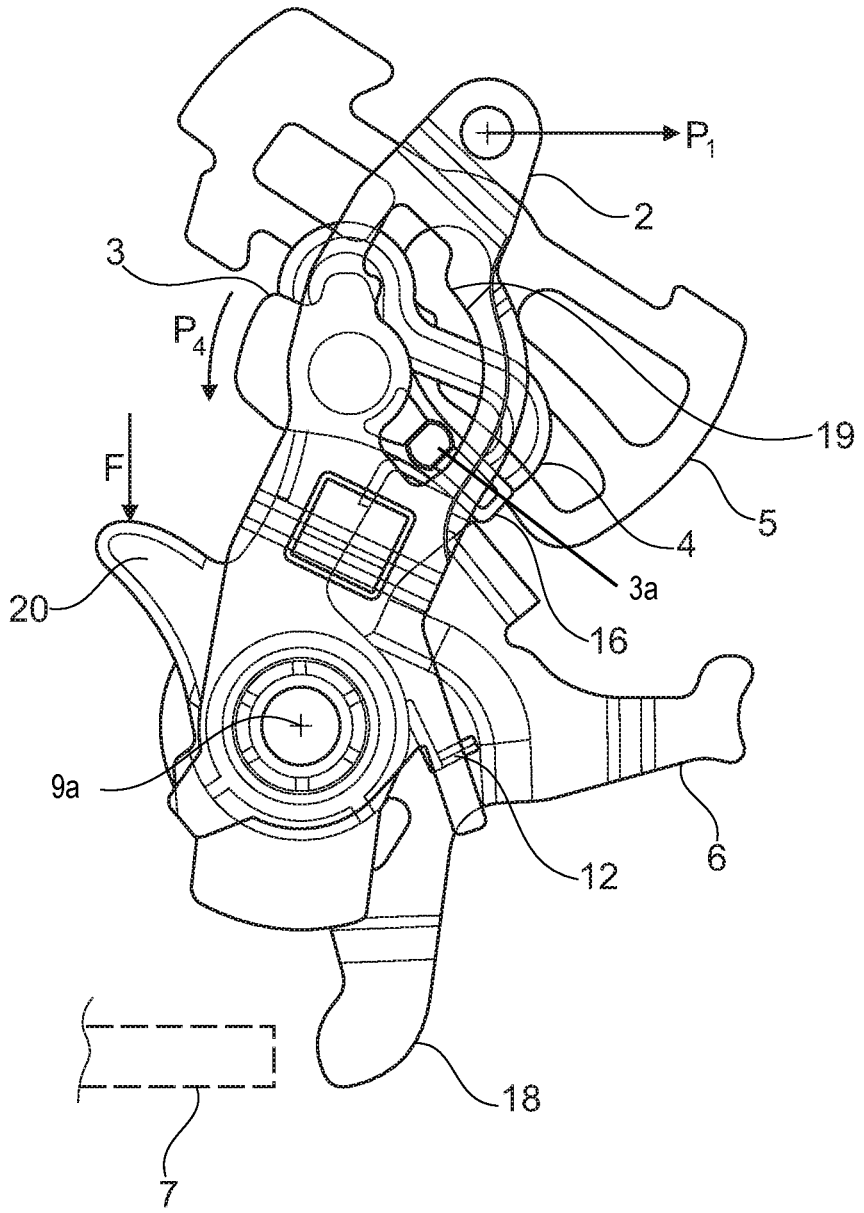

The case is now illustrated in FIG. 4 in which the actuating lever 2 is rotated with excess speed in the direction of the arrow P1 around the axis 9*a* in a clockwise direction. Excess speed which leads to excessively quick movement of the actuating lever 2 above a limit speed leads, on the one hand, to the spring element 12 being deflectable and simultaneously that the mass inertia element cannot follow the accelerated movement of the actuating lever 2. The coupling lever 3 is accommodated in the actuating lever 2 and must follow the movement of the actuating lever 2. However, as the control lever 4 remains in its starting position, the pin 10 of the coupling lever 3 is guided in the control cam 11 of the control lever 4. The coupling lever 3 thus pivots in FIG. 4 in an anti-clockwise direction and disengages with the triggering lever 6. As is clearly apparent in FIG. 4, the radial end 16 of the coupling lever 3 disengages with the stop edge 17 of the triggering lever 6. The triggering lever 6 remains in its starting position so that the triggering arm 18 cannot be brought into contact with the locking mechanism 7. In this movement, a section 3*a* of the coupling lever 3 protrudes in the aperture 19 of the actuating lever 2 and also moves in the aperture 19 of the actuating lever 2.

In order to disengage the coupling lever 3 with the triggering lever 6, the control lever 4 furthermore has an engagement means 20 which is formed as an extension 20 in this embodiment. If a non-illustrated lever is engaged with the extension 20 in the lock 1, for example, wherein the non-illustrated lever exerts a force F on the extension 20, the control lever 4 thus also remains in its starting position. The remaining of the control lever 4 in its starting position causes the coupling lever 3 to be guided in the control cam 11 of the control lever 4 during operation of the actuating lever 2 and thus the coupling lever 3 disengages with the triggering lever 6. The lock 1 can thus be bolted.

As is clearly apparent in the exemplary embodiment, a multitude of advantages are attained by the exemplary embodiment, whereby only the least possible spatial requirements are necessary, whereby the highest level of security can be attained by the construction, in particular the insertion of a control cam into the control lever.

LIST OF REFERENCE SYMBOLS

1 Lock
2 Actuating lever
3 Coupling lever
4 Control lever
5 Mass inertia lever
6 Triggering lever
7 Locking mechanism, pawl
8 Functional unit
9 Axis
10 Pin
11 Control cam
12 Spring element
13 Guide pin
14 Control cam
15 Axis
16 Radial end
17 Stop edge
18 Triggering arm
19 Aperture
20 Engagement means, extension
P1, P2, P3, P4 Arrow
F Force

The invention claimed is:

1. A lock for a side door lock of a motor vehicle, the lock comprising:

a locking mechanism;

a triggering lever engageable with the locking mechanism;

an actuating lever;

a coupling lever pivotably accommodated in the actuating lever;

a control lever configured to guide the coupling lever; and a mass inertia lever having a control contour for guiding the control lever, wherein the triggering lever is coupled to the actuating lever by the coupling lever, wherein the coupling lever is guided by a control cam of the control lever, and wherein the control lever has an extension configured to disengage the coupling lever from the triggering lever during an excessive speed of the actuating lever.

2. The lock for a motor vehicle according to claim 1, wherein the control lever is accommodated relative to the actuating lever on a joint axis.

3. The lock according to claim 1, wherein the extension is electrically operated.

4. The lock for a motor vehicle according to claim 1, wherein at least one section of the coupling lever protrudes into an aperture of the actuating lever and is guided into the aperture.

5. The lock for a motor vehicle according to claim 1, wherein the actuating lever, the control lever and the triggering lever are accommodated on a joint axis and/or a guide.

* * * * *